US011345497B2

(12) United States Patent
Rossney et al.

(10) Patent No.: US 11,345,497 B2
(45) Date of Patent: May 31, 2022

(54) STRAP GUIDANCE FRAME HAVING MAGNETIC CLOSURE DEVICE

(71) Applicant: MOSCA GMBH, Waldbrunn (DE)

(72) Inventors: Tobias Rossney, Schoenbrunn (DE); Felix Johannes Van Der Beek, Heidelberg (DE)

(73) Assignee: Mosca GmbH, Waldbrunn (DE)

( * ) Notice: Subject to any disclaimer, the term of this patent is extended or adjusted under 35 U.S.C. 154(b) by 0 days.

(21) Appl. No.: 17/295,105

(22) PCT Filed: Oct. 8, 2019

(86) PCT No.: PCT/EP2019/077235
§ 371 (c)(1),
(2) Date: May 19, 2021

(87) PCT Pub. No.: WO2020/114652
PCT Pub. Date: Jun. 11, 2020

(65) Prior Publication Data

US 2021/0394939 A1 Dec. 23, 2021

(30) Foreign Application Priority Data

Dec. 7, 2018 (DE) ..... 102018131395.0

(51) Int. Cl.
*B65B 13/06* (2006.01)
*B65B 13/18* (2006.01)

(52) U.S. Cl.
CPC ..... *B65B 13/06* (2013.01); *B65B 13/185* (2013.01)

(58) Field of Classification Search
CPC ..... B65B 13/06; B65B 13/08; B65B 13/14; B65B 13/16; B65B 13/18
(Continued)

(56) References Cited

U.S. PATENT DOCUMENTS 3,020,827 A * 2/1962 Luthi ..... B65B 13/06 100/26
4,781,110 A * 11/1988 Sakaki ..... C01B 7/04 100/26
(Continued)

FOREIGN PATENT DOCUMENTS

DE 25 07 717 C3 9/1976
DE 20 2005 017 864 U1 2/2006
(Continued)

*Primary Examiner* — Jimmy T Nguyen
(74) *Attorney, Agent, or Firm* — Muirhead and Saturnelli, LLC

(57) ABSTRACT

A strapping machine may include a strap guidance frame having a strap guidance channel and a plurality of closure elements, which may be arranged in a distributed manner over the length of the channel and may be movable from a position closing the channel into a position opening the channel. The closure elements may be fixable in the position closing the channel by means of a closure force that is generated by a magnetic closure device. The wear of the closing elements of the strapping machine may be reduced compared to known strapping machines. The magnetic closure device may have a displacement means for displacing at least part of the magnetic closure device so that the closure force is cancelled or an opening force directed counter to the closure force is generated.

14 Claims, 8 Drawing Sheets

(58) Field of Classification Search
USPC ..... 100/26
See application file for complete search history.

(56) References Cited

U.S. PATENT DOCUMENTS

| | | | | |
|---|---|---|---|---|
| 5,442,899 | A | 8/1995 | Shibazaki et al. | |
| 7,412,815 | B2 * | 8/2008 | Schmetzer | B29C 66/4322 100/32 |
| 2008/0276578 | A1 | 11/2008 | Kastner | |

FOREIGN PATENT DOCUMENTS

| | | | | | |
|---|---|---|---|---|---|
| DE | 10 2005 054 529 | A1 | | 5/2007 | |
| DE | 10 2014 213 791 | A1 | | 1/2016 | |
| EP | E 0 703 145 | A1 | | 3/1996 | |
| EP | 0 738 658 | | | 8/1998 | |
| EP | 1 702 844 | A1 | | 9/2006 | |
| GB | 615617 | | | 1/1949 | |
| JP | 2000-203514 | A | | 7/2000 | |
| JP | 2000203514 | A | * | 7/2000 | B65B 13/06 |
| WO | WO 00/56606 | A1 | | 9/2000 | |

* cited by examiner

STRAP GUIDANCE FRAME HAVING MAGNETIC CLOSURE DEVICE

TECHNICAL FIELD

The system described herein relates to a strapping machine comprising a strap guide frame having a strap guide channel and a plurality of closing elements which are arranged in a distributed manner over the length of the channel and which can be moved from a position closing the channel into a position opening the channel counter to a return force, wherein the closing elements can be fixed in the position closing the channel via a closing force which is generated by a magnetic closure device. The system described herein also relates to a method for strapping items with such a strapping machine.

Such a strapping machine is known from publication EP 702 844 B1. The magnetic closure device reliably generates a closing force in a wear-free manner, which closing force keeps the strap guide channel closed. After the end of strapping, a retraction drive pulls the strap back out of the strap guide channel, wherein the strap is pulled against the closing elements and opens the closing elements counter to the closing force. In the case of the embodiment described here, the closing elements are fastened in a flap-like and pivotable manner to the strap guide frame in such a manner that they cover the strap guide channel if the closing parts on the strap guide frame and the closing element adjoin one another, wherein the magnetic force of the closing parts fixes the closing element in this closed position. When opening the closing elements by pulling the strap out of the strap guide channel, a force must act which is greater than the magnetic force in order to open the closing elements. This leads to the strap sliding past the edge of the closing element during opening with increased force, as a result of which significant wear arises which leads to an increased service and repair outlay. Publication DE 25 07 717 C3 discloses a strapping machine with a device for keeping the channel flaps closed, which channel flaps are actuated via cables. A pulling force is exerted on the cable by a spring, a weight, a pneumatic or hydraulic piston or electromagnetically.

The strap is furthermore displaced by the undefined opening movement of the flaps. As a result of this, the positioning of the strap on the product cannot be realized in a precise manner.

One further significant disadvantage is that a minimum distance from the product to the frame must be observed to so that the flaps reliably open. The selection of the flap geometry is also very significantly dependent on the dynamic processes when opening the flaps by pulling out the strap. The flap geometries cannot be freely selected with the objective of optimum frame covering, rather must be defined so that reliable opening of the flaps is ensured.

The development of noise of the flaps during opening by pulling out the strap is also very high. The outlay of force to open the flaps subject to the magnetic force also leads to the use of a drive motor with a transmission stage to generate the required retraction force of the strap.

It is desired to create a strapping machine, in the case of which at least some of the above-mentioned disadvantages are overcome. It is desired to reduce the wear of the closing elements (flaps), avoid a displacement of the strap caused by opening the flaps, enable the free selection of the flap geometries, reduce the development of noise and the required retraction force.

SUMMARY OF THE INVENTION

In an embodiment of the system described herein, a magnetic closure device has a displacement means for displacement of at least a part of the magnetic closure device, as a result of which the closing force may be cancelled or an opening force directed counter to the closing force may be generated.

By means of the displacement means, the position of at least a part of the magnetic closure device may be changed so that the closing force drops to zero. This may be, for example, the case if a magnetic closing part is displaced from a position in which it is opposite and attracts another magnetic closing part in such a manner that it is opposite a non-magnetic material portion e.g. made of plastic so that no magnetic closing force is generated any more. The closing parts then may open in a resistance-free manner. If the closing parts are arranged pivotably at the bottom on a horizontally running portion of the strap guide frame, the closing parts may pivot into the opening position as a result of their weight in the event of cancelation of the closing force. The cancelation of the closing force may largely avoid the wear of the closing parts during opening caused by the strap.

However, by means of the displacement means, the magnetic closure device also may be configured so that, in an opening position, two magnetic closing parts with opposite polarity are opposite one another, of which one is arranged on the strap guide frame and one on the movable closing element. The two closing parts then may repel one another and generate an opening force which may push the closing element into the opened position. As a result of this, any contact between strap and closing part may be avoided during contraction of the strap loop formed in the strap guide channel.

The closing elements may be flap-shaped and may be fastened pivotably to the strap guide frame. In the closing position, they may cover the strap guide channel. Flap-shaped closing elements may be the most frequent embodiments of closing elements. The closing elements may be formed to be L-shaped, wherein their lateral limbs may be fastened pivotably to the strap guide frame and the limbs facing the center of the strap guide frame may cover the strap guide channel. However, other flap-shaped closing elements are also known, for example, from EP 1 702 844 B1. It may be vital that the portions of the closing elements which cover the strap guide channel may be moved in such a manner that the strap guide channel is released and a strap in the strap guide channel may be pulled out in order to form a loop bearing tightly around a package. A plurality of closing elements may be normally distributed over the length of the strap guide frame. Each of the closing elements may form a flap. In the case of L-shaped closing elements, it is also known to use in each case pairs of closing elements, of which each may cover half of the strap guide channel. These pairs of flap-shaped closing elements then may flap apart like wings when the strap guide channel is opened.

In practice, the magnetic closure device may have two closing parts which interact with one another, of which one is fastened to a closing element and the other is fastened to the strap guide frame. One of the two closing parts should be permanent-magnetic in order to generate the closing force when oriented with respect to the second closing part. The other closing part may be either permanent-magnetic or ferromagnetic and may be magnetically attracted by the first closing part.

As mentioned further above, in practice, the displacement means may displace one of the closing parts which interact with one another. For the plurality of closing elements of the strap guide frame, the magnetic closure device may have a displacement means which brings about a cancelation of the closing force for each closing element, e.g., by displacement of one of the two closing elements which interact with one another. Thus, by means of an activation of the displacement means, e.g. a displacement, all of the closing elements of the strap guide frame may be simultaneously opened or at least rendered force-free.

In practice, the displacement means may displace the displaceable closing part from a closing position, in which it may be located close to the stationary closing part, into an opening position, in which it may be remote from the stationary closing part. In an embodiment, as a result of the greater distance, no effective magnetic force is then generated any more.

Moreover, the magnetic closure device may have an opening part which, in the opening position, lies close to a closing part. If the relevant closing part and the opening part are both permanent-magnetic and identical poles of the closing part and the opening part face one another, a repelling magnetic force which pushes the closing element into the opening position may be generated between this closing part and the opening part. In the opening position of the closing element, the strap guide channel may be completely opened so that the strap may escape from the strap guide channel without contact with the closing element.

As mentioned, the magnetic closure device may have at each closing element a closing part and a second closing part assigned to this closing part and fastened to the strap guide frame. These two closing parts may pull the closing element magnetically into the closed position.

The displacement means may in practice be fastened to the strap guide frame. The displacement means may have an actuating drive which brings about the displacement of the closing parts on the strap guide frame. The actuating drive may bring about a displacement of the displaceable closing part in both directions, i.e., in the closing direction and in the opening direction. The actuating drive also may, however, only act on one side and may generate an opening force with which the displaceable closing part is displaced into the opening position. The closing parts which interact with one another may generate a magnetic closing force acting in the opposite direction and displacing the displaceable closing part into the closing position.

In the case of one particular embodiment of the strapping machine, each of the two opposite and pivotable closing elements may have a limb which projects toward the center of the strap guide frame, wherein two free end faces of these limbs may adjoin one another in the position closing the channel and wherein each of these limbs may have, proceeding from the respective free end face, a gap and the gaps which lie opposite one another jointly may form the strap guide channel. In other words, the short limbs, facing one another, of the L-shaped flaps may form an integrated strap channel because they may have parallel gaps proceeding from their free end faces, which gaps may be flush with one another and in each case may form a half of the strap guide channel. A corner element of the strap guide frame may have similar strap channel halves which may be integrated into the flaps and which may run along a path curved circularly over 90°. These strap channels integrated into the flaps or portions of the strap channels may enable highly precise guide of the strap with a low degree of play.

In an embodiment of the system described herein, a method for strapping items with a strapping machine is provided, where the strapping machine has a strap guide frame having a strap guide channel and a plurality of closing elements which may be arranged in a distributed manner over the length of the channel and which may be moved from a position closing the channel into a position opening the channel counter to a restoring force, wherein the closing elements may be fixed in the position closing the channel via a closing force which may be generated by a magnetic closure device. In order to reduce the wear of the closing elements, by altering the magnetic closure device, the closing force may be canceled or an opening force directed opposite to the closing force may be generated.

The magnetic closure device may have two closing parts which interact with one another, of which one may be fastened to a closing element and the second may be fastened to the strap guide frame and of which one may be permanent-magnetic and the other may be either permanent-magnetic or ferromagnetic, wherein one of the closing parts may be displaced to alter the magnetic closure device.

The displaceable closing part may be displaced from a closing position close to the stationary closing part into an opening position remote from the stationary closing part.

The magnetic closure device may have an opening part which, in the opening position, lies close to one of the closing parts, wherein this closing part and the opening part may be permanent-magnetic and identical poles of the closing part and the opening part may face one another.

In practice, an actuating drive may generate an opening force with which the displaceable closing part is displaced into the opening position, wherein the closing parts which interact with one another may generate a magnetic closing force with which the displaceable closing part is displaced into the closing position.

BRIEF DESCRIPTION OF THE DRAWINGS

Further practical embodiments and advantages of the system described herein are described below in conjunction with the drawings. In the drawings.

DESCRIPTION OF VARIOUS EMBODIMENTS

Figure 1:
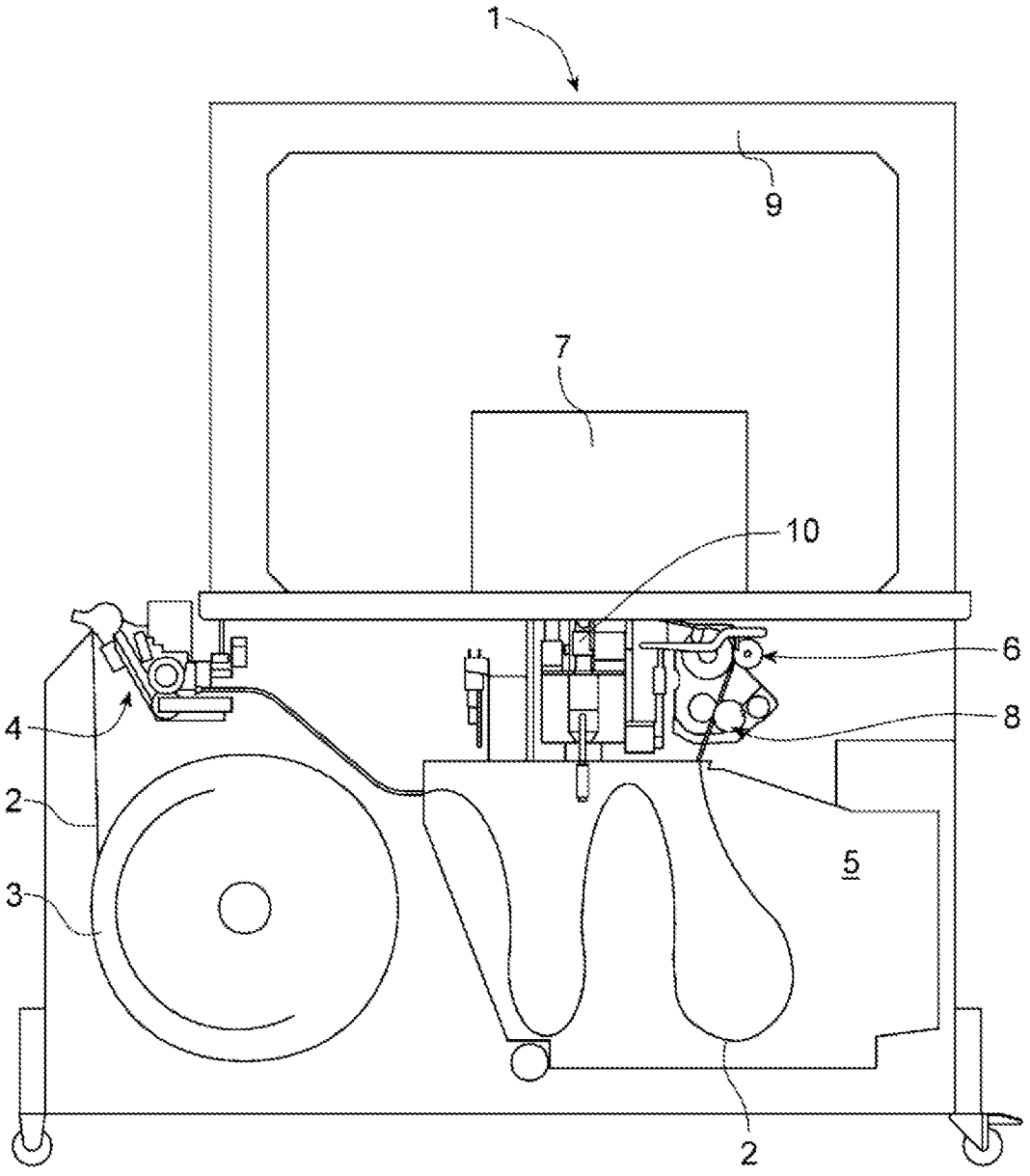
FIG. 1 shows a schematic side view of a strapping machine, according to an embodiment of the system described herein.

The strapping machine 1 represented in FIG. 1 serves to strap items 7 with a strap 2 which may be removed from a supply roll 3 by a pull-in device 4 and supplied to a strap magazine 5. From there, the strap 2 may be supplied by means of a strap conveying device 6 through a tensioning device 8 to a strap channel on a strap guide frame 9 so that the strap 2 may form a loop. The strap 2 may be subsequently retracted by the drive of the strap conveying device 6 so that the strap loop bears tightly against the item 7. The tensioning device 8 now may be activated so that the strap loop is pulled around the item 7 with a predefined high tensioning force. The strap conveying device 6 and the tensioning device 8 jointly may form the strap drive. They also may be combined to form one drive device.

The tensioned loop may be subsequently cut off from the strap supply. The start of the loop may be connected to the end of the loop by means of a closure assembly 10. The closure assembly 10 may comprise in practice, e.g., a welding device which welds the two ends of the formed packing strap loop to one another. The closure assembly 10 may weld the film-like plastic material of which the strap may be composed. The conveyor with which the item 7 may be transported into and out of the strapping zone within the strap guide frame is not represented in FIG. 1.

Figure 3:
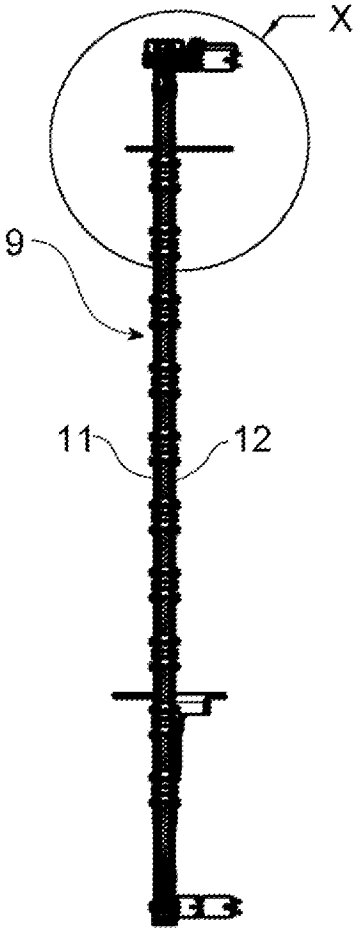
FIG. 3 shows a sectional view through the left limb in FIG. 2 of the strap guide frame from FIG. 2, according to an embodiment of the system described herein.
Figure 2:
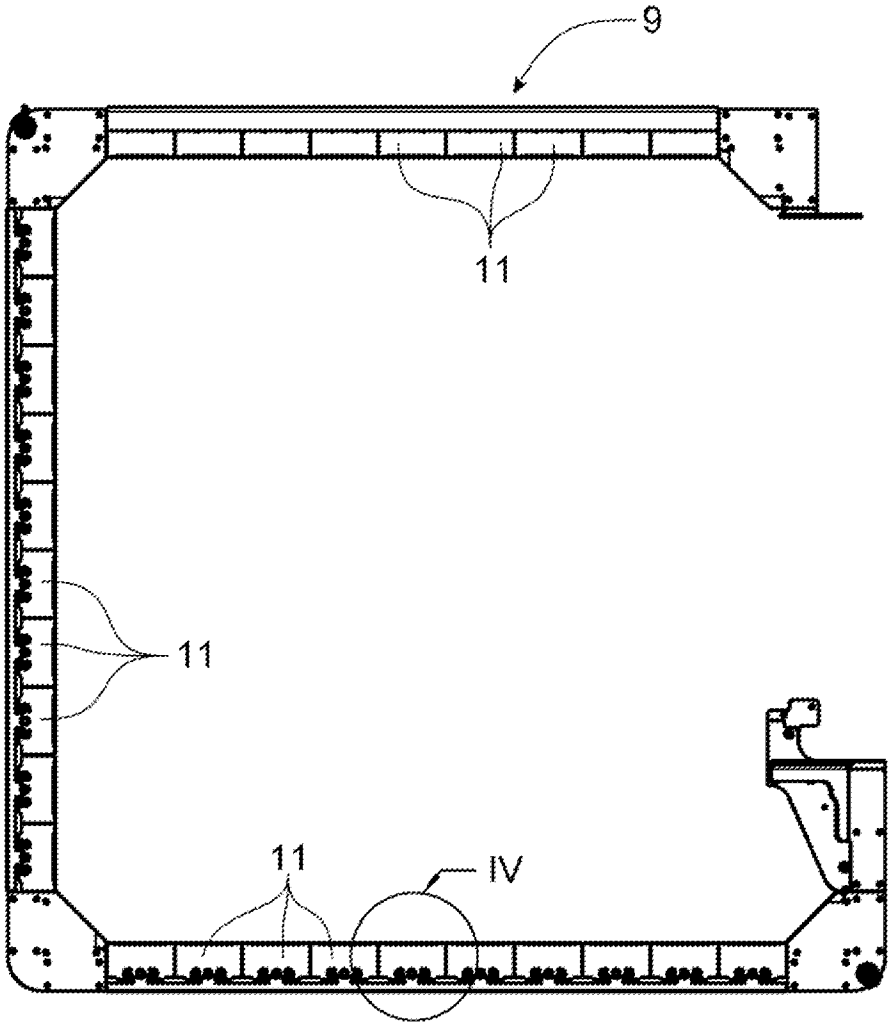
FIG. 2 shows an isolated side view of a strap guide frame (flap frame), which is arranged lying on the side so that the lower limb in FIG. 2 is the left limb in FIG. 1, according to an embodiment of the system described herein.

FIG. 2 shows an isolated representation of the strap guide frame 9, which may be formed as a flap frame, in side view. The strap guide frame 9 in FIG. 2 is rotated by 90° in an anti-clockwise direction with respect to the strap guide frame 9 in FIG. 1 so that the interrupted limb on which the closure assembly is arranged lies on the right. FIG. 3 shows a sectional view of the left limb of the strap guide frame from FIG. 2. It is apparent in FIG. 2 that several consecutive flaps 11 may be arranged along the straight portions of the strap guide frame 9, which flaps 11 may form closing elements for the strap guide channel 24 (see FIG. 12). Only some of the flaps 11 of each of the three continuous limbs of the strap guide frame 9 are provided with reference numbers in FIG. 2.

Figure 4:
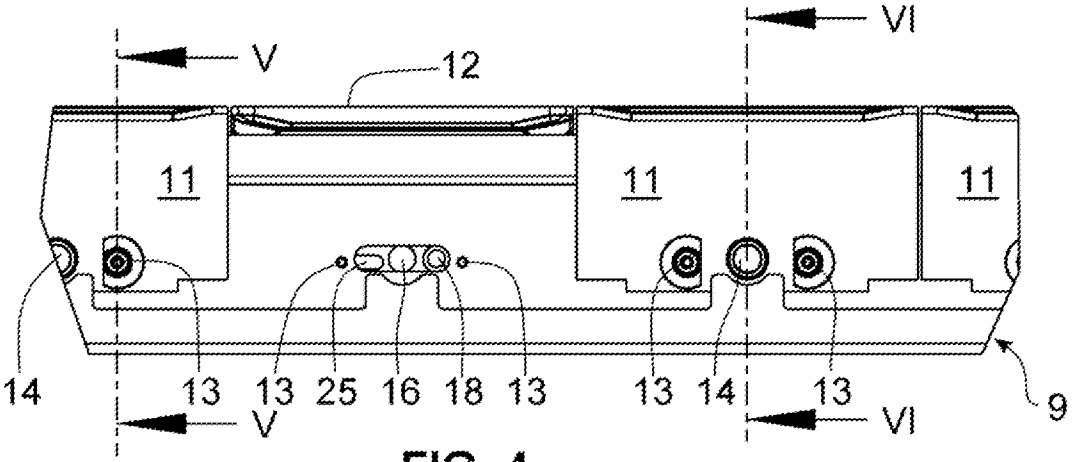
FIG. 4 shows a sectional view of detail IV of the strap guide frame from FIG. 2 with closed closing elements, wherein one closing element is removed, according to an embodiment of the system described herein.

FIG. 4 shows an enlarged side view of detail IV in FIG. 2 which represents a portion, comprising approximately three flap lengths, of the limb, at the bottom in FIG. 2, of the strap guide frame 9. Here, a flap 11 is represented fully and two flaps 11 partially. A flap is removed in the center in order to be able to better explain the function.

Figure 5:
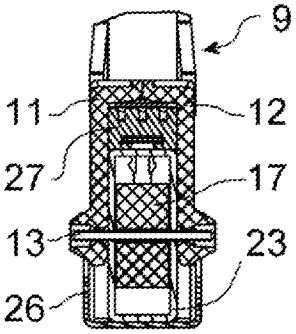
FIG. 5 shows a sectional view along sectional line V-V in FIG. 4, according to an embodiment of the system described herein.

FIG. 5 shows a representation of FIG. 4 sectioned along sectional line V-V. Sectional line V-V runs through a bearing pin 13, which is apparent in particular in FIG. 5 and which mounts the flap 11 pivotably and connects it to the strap guide frame 9. It is apparent that the flap 11 may have approximately the cross-section of an L rotated by 180°, the short limb of which projecting toward the center of the strap guide frame 9 in FIGS. 5, 6, 8, 9, 12,13 runs horizontally and lies at the top. The long limb runs parallel to the side surface of the strap guide frame 9 and may be mounted pivotably thereon by the bearing pin 13. The short limb covers the left half of the strap guide channel 24 which is apparent in particular in the enlarged representation of FIGS. 12 and 13. The right half of the strap guide channel 24 may be covered by an opposite flap 12 which may be formed in mirror-symmetry to flap 11 and may be mounted pivotably at the opposite end of the bearing pin 13. Each flap 11, 12 may be fastened pivotably to the strap guide frame 9 by the ends of two bearing pins 13.

Figure 6:
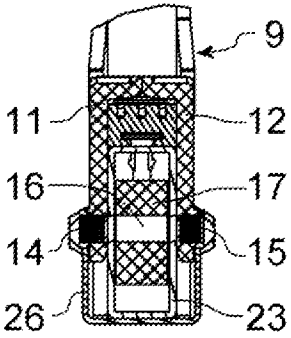
FIG. 6 shows a sectional view along sectional line VI-VI in FIG. 4, according to an embodiment of the system described herein.

FIG. 6 shows a representation sectioned along sectional line VI-VI of the strap guide frame 9 from FIG. 4. The sectional line VI-VI runs through a magnetic closing part 14 which may be arranged in the center of the flap 11. The opposite flap 12 likewise may have in its center a magnetic closing part 15. FIGS. 4 to 6 show the flaps 11 and 12 in a closing position. In this closing position, the two magnetic closing parts 14, 15 of the flaps 11,12 may be flush with a steel bolt 16 which may be arranged displaceably in the strap guide frame 9 between the flaps 11, 12. The steel bolt 16 may be ferromagnetic and exert a magnetic closing force on the adjacent magnetic closing part 14 or 15. The magnetic closing parts 14, 15 may be in practice permanent-magnetic. The steel bolt 16 may form for each of the magnetic closing parts 14, 15 a complementary magnetic closing part. The polarity of the magnetic closing parts 14,15 should be selected so that a sufficiently large closing force may be generated on both sides of the steel bolt 16. For this purpose, the two surfaces, facing the steel bolt 16, of the magnetic closing parts 14, 15 may have opposite polarity.

Enlarged views of FIGS. 5 and 6 which illustrate in particular the structure of the strap guide frame 9 are explained further below in association with FIGS. 12 and 13.

Figure 7:
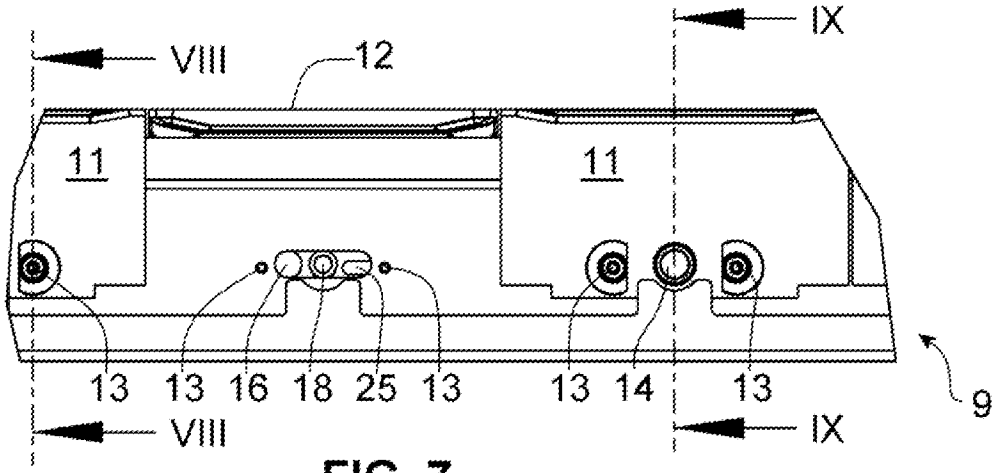
FIG. 7 shows a side view of a portion of the strap guide frame with opened closing elements, wherein one closing element is removed, according to an embodiment of the system described herein.
Figure 9:
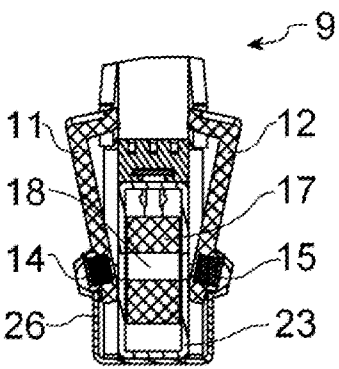
FIG. 9 shows a sectional view along sectional line IX-IX in FIG. 7, according to an embodiment of the system described herein.
Figure 8:
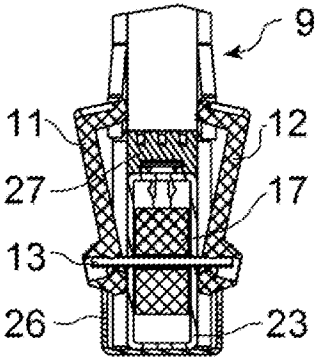
FIG. 8 shows a sectional view along sectional line VIII-VIII in FIG. 7, according to an embodiment of the system described herein.

FIGS. 7 to 9 correspond to FIGS. 4 to 6, but show the flap-shaped closing elements 11, 12 in the opening position. A plastic bar 17 in which a plurality of the steel bolts 16 are embedded may be arranged displaceably in the strap guide frame 9. Each steel bolt 16 may form a ferromagnetic closing part and may be assigned to a pair of permanent-magnetic closing parts 14, 15 which themselves may be fastened respectively to a closing element (flap) 11 or 12. The plastic bar 17 may be displaceable in the longitudinal direction of the strap guide frame 9 and may form a displacement means for the displaceable, ferromagnetic closing part 16. An opening magnet 18 may be arranged on the plastic bar 17 in the longitudinal direction of the strap guide frame 9 adjacent to the steel bolt 16, which opening magnet 18 may form an opening part of the magnetic closure device. Each steel bolt 16 may be assigned an opening magnet 18. It is apparent in FIG. 7 that the plastic bar 17, in the opening position, may be displaced in such a manner that the opening magnet 18 is flush with the two stationary, magnetic closing parts 14 and 15. The opening magnet 18 may have such polarity that in each case identical poles of the magnetic closing parts 14, 15 and of the opening magnet 18 face one another. The opening magnet 18 consequently may repel the magnetic closing parts 14 and and move the flaps 11, 12 into the opening position which is apparent in FIGS. 8 and 9. In this opening position, the strap guide channel may be entirely open and a strap received in the strap guide channel may escape from the strap guide channel without touching one of the closing elements (flaps 11,12).

Figure 10:
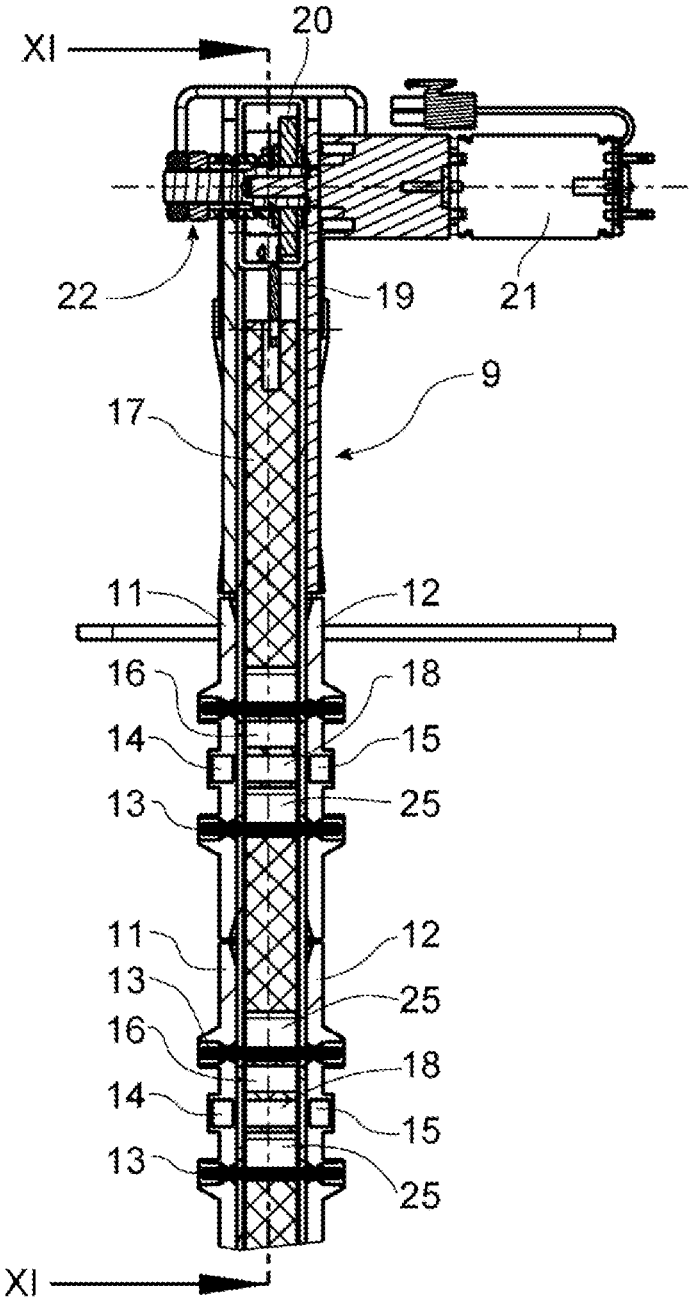
FIG. 10 shows an enlarged view of detail X in FIG. 3 which shows a corner of the strap guide frame, according to an embodiment of the system described herein.
Figure 11:
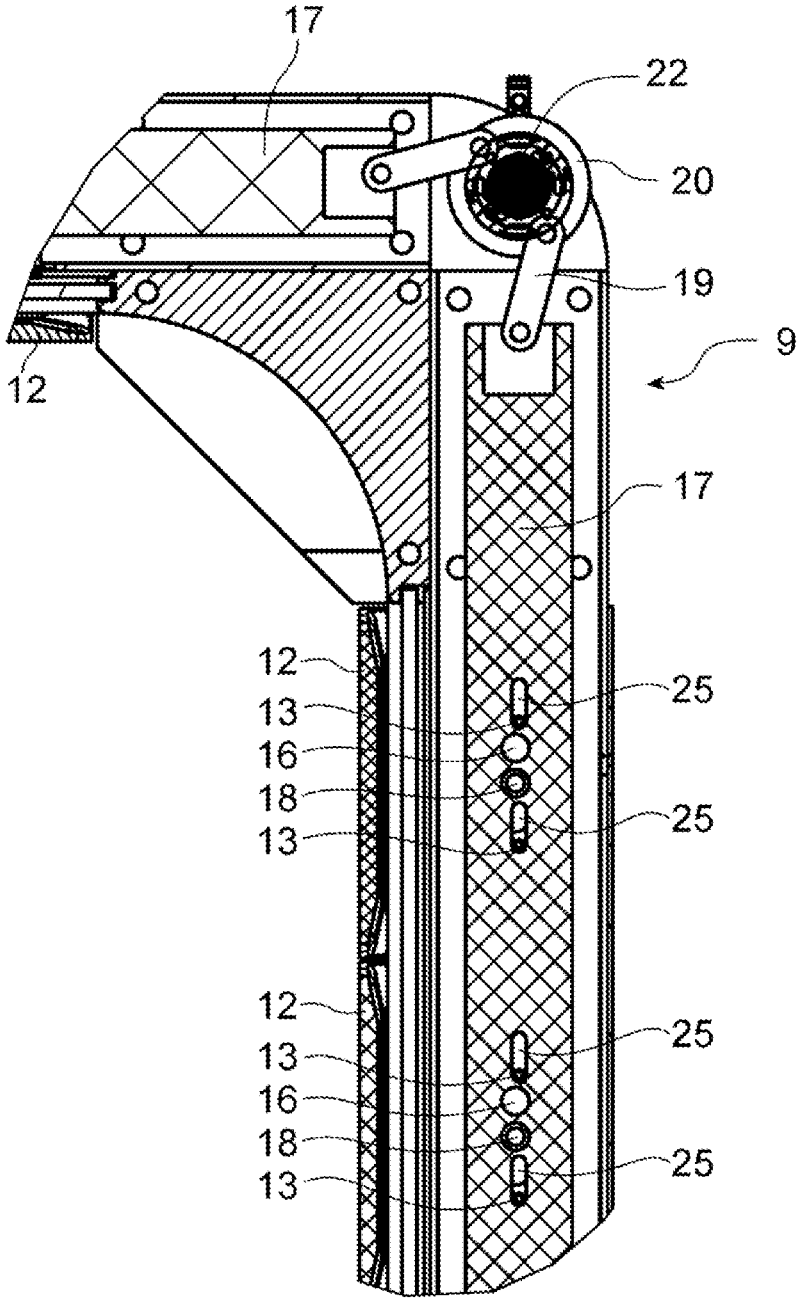
FIG. 11 shows a sectioned view along sectional line XI-XI of the corner of the strap guide frame from FIG. 10, according to an embodiment of the system described herein.

FIGS. 10 and 11 show a corner region of the strap guide frame 9 which is marked in FIG. 3 as detail X. Two ends of the plastic bars 17 of two perpendicular limbs of the strap guide frame 9 are apparent in FIG. 11. The actuating drive for the two plastic bars 17 is apparent in FIG. 11. Each plastic bar 17 may be coupled via a drive rod 19 to a rotatably mounted drive disk 20. As is apparent in FIG. 10, the drive disk 20 may be displaced by a drive motor 21 with a friction clutch 22 into two discrete positions, namely the opening position and closing position. The plastic bars 17 likewise may be displaced via the drive rods 19 into the opening position or the closing position, in which on one hand the opening magnets 18 as opening parts may be opposite the magnetic closing parts 14 and 15 of the flap-shaped closing elements 11, 12 and on the other hand the steel bolt 16 on the plastic bar 17 may be opposite the magnetic closing parts 14, 15 of each flap 11, 12, wherein the steel bolt may form a ferromagnetic closing part for each of the two closing elements 11, 12.

The plastic bar may have elongated holes 25 to receive the bearing pins 13 which guide and fasten the plastic bar 17 on the strap guide frame 9. The elongated holes 25, through which the bearing pins 13 project, of the plastic bar 17 are apparent in, e.g., FIG. 11.

Figure 13:
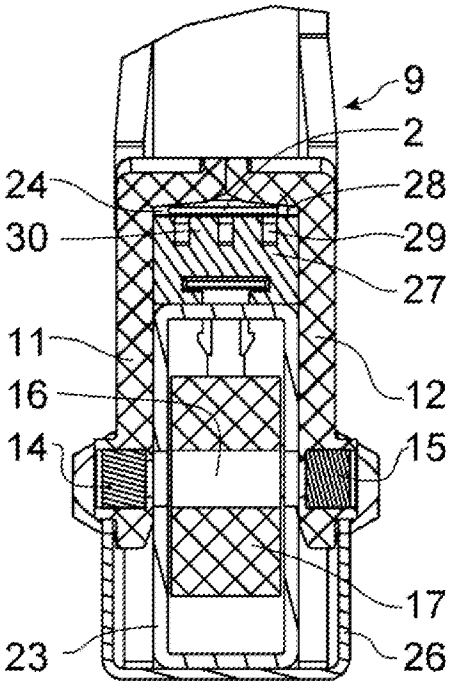
Figure 12:
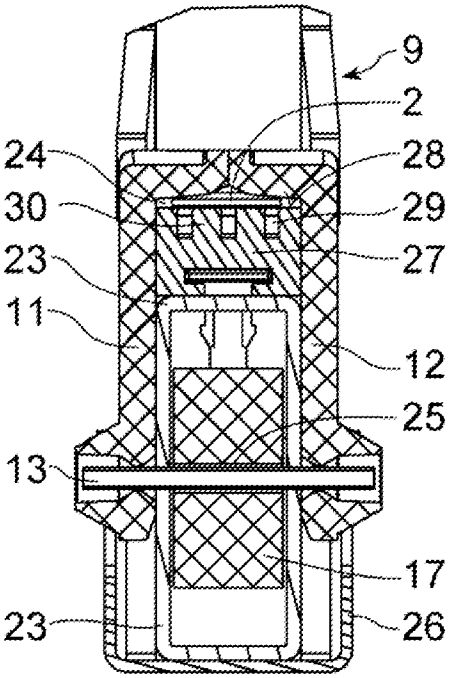
FIG. 12, 13 show enlarged views of the sectional representations of FIGS. 5 and 6, according to an embodiment of the system described herein.

The structure of the strap guide frame is apparent in detail in FIGS. 12-13. The structural strength of the strap guide frame 9 may be ensured by a rectangular hollow profile 23 composed of sheet metal which surrounds the plastic bar 17 and in which the plastic bar 17 may be received displaceably. A U-shaped covering profile 26 which covers the outside of the hollow profile 23 and the mountings for the flaps 11, 12 in a protective manner may be arranged on the outside of the hollow profile 23. A strap guide profile 27, which may be composed of plastic, the surface of which may face the inside of the strap guide frame and form the guide surface 28 for the strap 2, may be arranged on the inside of the hollow profile 23 facing the inside of the strap guide frame 9. The strap 2 is apparent in FIGS. 12 and 13. In order to keep the friction between the strap 2 and the guide surface 28 as low as possible, the guide surface 28 may have webs 30 interrupted by grooves 29, which webs 30 may form the support for the strap 2. The flaps 11,12 and 13 may be composed of plastic and may bear laterally against the side walls of the strap guide profile.

It is apparent that the flaps 11, 12 may be closed by displacement of the plastic bar 17 from the opening position into the closing position and the flaps 11, 12 may be opened by displacement from the closing position into the opening positions. For this purpose, in the opening position, the plastic bar 17 may lie in relation to the magnetic closing parts 14, 15 of the flaps 11, 12 such that in each case an opening magnet 18 is flush with the magnetic closing parts 14,15, which may be opposite one another and may generate an opening force between the opening magnet 18, which may form the opening part, and the closing parts 14, 15 because one end of a magnetic closing part 14,15 may be opposite each end of the opening magnet 18.

It is apparent for the person skilled in the art that the opening magnet 18 on the plastic bar 17 may be dispensed with. In this case, no opening force may be generated when displacing the plastic bar 17 into the opening position, rather the flap-shaped closing element 11, 12 may be held without force on the strap guide frame 9, because a non-magnetic plastic portion of the plastic bar 17 may be opposite each magnetic closing part 14,15.

In contrast, in the closing position, the ferromagnetic steel bolt 16 may be opposite the magnetic closing parts 14,15 so that the closing parts 14,15 are magnetically attracted.

It is likewise apparent for the person skilled in the art that the displacement of the plastic bars 17 or the displacement of the steel bolts 16 as a ferromagnetic closing part or of the opening magnet 18 as an opening part may be brought about in a different manner than by a drive motor. The displacement may be generated by any other desired actuating drive or linear motor, for example, a solenoid linear motor. It also may be possible to use the magnetic force which prevails between the magnetic closing parts 14,15 at the flaps 11, 12 and the magnetic closing part at the plastic bar 17 to displace the plastic bar 17 into the closing position. In this closing position, the closing parts may attract one another so that this magnetic force brings about the displacement of the movable plastic bar into the closing position.

Figure 15:
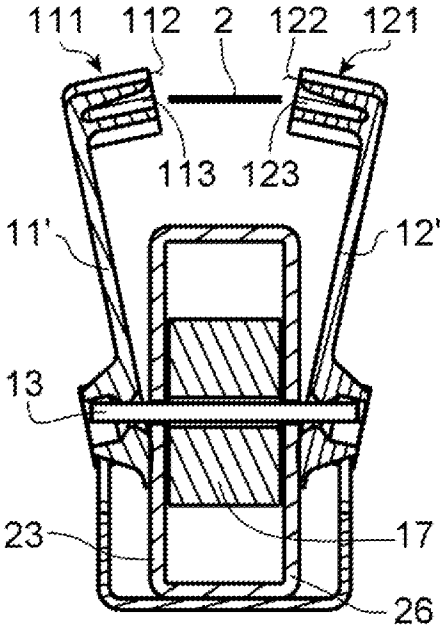
FIG. 15 shows a sectional representation of the strap guide frame from FIG. 14 with opened closing elements, according to an embodiment of the system described herein.
Figure 14:
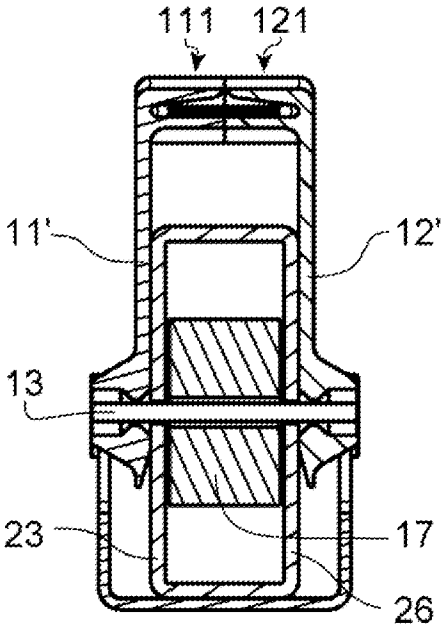
FIG. 14 shows an enlarged view of a sectional representation of an alternative embodiment of the strap guide frame with closed closing elements, according to an embodiment of the system described herein.

FIGS. 14 and 15 show a sectional representation through the bearing pins 13 of an alternative embodiment of a strap guide frame, the closing elements 11', 12' of which may have an integrated strap path. The closing elements 11', 12' may be in turn formed as an L-shaped, pivotable flap. Each of the closing elements 11', 12' may have a limb 111,121 which projects toward the center of the strap guide frame, may lie at the top in FIGS. 14 and 15 and may run horizontally. Each of these limbs 111, 121 may have a gap 113, 123 opening out in the respective free end face 112, 122 of the horizontal limb 111, 121. The free end faces 112, 122 may adjoin one another in the position of the closing elements 11', 12' closing the channel so that the two gaps 113, 123 which may be opposite one another jointly form the strap guide channel (see FIG. 14). When the flap-shaped closing elements 11', 12' swing open, the gaps 113, 123 may move away from one another and release the strap 2 which may be lying between them (see FIG. 15). The corner elements of the strap guide frame may have similar flap-shaped closing elements, wherein the gaps may have, however, a profile curved along a circular arc of 90° and may form a curved portion of the strap guide channel.

The features of the system described herein disclosed in the present description, in the drawings and in the claims may be significant both individually and in any desired combinations for the achievement of the system described herein in its various embodiments. The invention is not restricted to the described embodiments. It may be varied in the scope of the claims and taking into account the knowledge of the relevant person skilled in the art. Other embodiments of the invention will be apparent to those skilled in the art from a consideration of the specification and/or an attempt to put into practice the system described herein. It is intended that the specification and examples be considered as illustrative only, with the true scope and spirit of the invention being indicated by the following claims.

The invention claimed is:

1. A strapping machine comprising:

a strap guide frame having a strap guide channel, a plurality of closing elements fastened to the strap guide frame, wherein the closing elements are arranged in a distributed manner over the length of the channel and the closing members are configured to move from a position closing the channel into a position opening the channel counter to a restoring force, wherein the closing elements can be fixed in the position closing the channel via a closing force which is generated by a magnetic closure device having two closing parts which attract one another magnetically, a first one of the closing parts is fastened to one of the closing elements and a second one of the closing parts is fastened to the strap guide frame, and wherein the magnetic closure device displaces the second closing part relative to the strap guide frame, as a result of which the closing force is canceled or an opening force directed counter to the closing force is generated.

2. The strapping machine as claimed in claim 1, wherein the closing elements are flap-shaped and are fastened pivotably to the strap guide frame and cover the strap guide channel.

3. The strapping machine as claimed in claim 1, wherein one of the closing parts is permanent-magnetic and the other of the closing parts is either permanent-magnetic or ferromagnetic.

4. The strapping machine as claimed in claim 3, wherein the magnetic closure device displaces the closing part that is fastened to the strap guide frame from a closing position close to the closing part that is fastened to one of the closing elements into an opening position remote from the closing part that is fastened to one of the closing elements.

5. The strapping machine as claimed in claim 4, wherein the magnetic closure device has an opening part which, in the opening position, lies close to a particular one of the closing parts, wherein the particular one of the closing parts and the opening part are permanent-magnetic and identical poles of the particular one of the closing parts and the opening part face one another.

6. A strapping machine comprising:

a strap guide frame having a strap guide channel, a plurality of closing elements fastened to the strap guide frame, wherein the closing elements are arranged in a distributed manner over the length of the channel and the closing members are configured to move from a position closing the channel into a position opening the channel counter to a restoring force, wherein the closing elements can be fixed in the position closing the channel via a closing force which is generated by a magnetic closure device, wherein the magnetic closure device has a displacement means for displacing at least a part of the magnetic closure device, as a result of which the closing force is canceled or an opening force directed counter to the closing force is generated, wherein the magnetic closure device has two closing parts which interact with one another, of which one is fastened to one of the closing elements to provide a stationary closing part and the other is fastened to the strap guide frame to provide a displaceable closing part and of which one is permanent-magnetic and the other is either permanent-magnetic or ferromagnetic, wherein the displacement means displaces the displaceable closing part from a closing position close to the stationary closing part into an opening position remote from the stationary closing part, and wherein the magnetic closure device has an opening part which, in the opening position, lies close to a particular one of the closing parts, wherein the particular one of the closing parts and the opening part are permanent-magnetic and identical poles of the particular one of the closing parts and the opening part face one another.

7. The strapping machine as claimed in claim 1, wherein magnetic closure device uses an actuating drive.

8. The strapping machine as claimed in claim 7, wherein the actuating drive generates an opening force with which the closing part that is fastened to the strap guide frame is displaced into the opening position, and wherein the closing parts interact with one another to generate a closing force with which the closing part that is fastened to the strap guide frame is displaced into the closing position.

9. The strapping machine as claimed in claim 2, wherein each of the two opposite and pivotable closing elements has a limb which projects toward the center of the strap guide frame, where two free end faces of these limbs adjoin one another in the position closing the channel, and wherein each of these limbs has, proceeding from the respective free end face, a gap and the gaps which lie opposite one another jointly form the strap guide channel.

10. A method for strapping items with a strapping machine comprising:

providing the strapping machine including a strap guide frame having a strap guide channel and a plurality of closing elements fastened to the strap guide frame, wherein the closing elements are arranged in a distributed manner over the length of the channel and are moveable from a position closing the channel into a position opening the channel counter to a restoring force, wherein the closing elements are fixable in the position closing the channel via a closing force which is generated by a magnetic closure device having two closing parts which attract one another magnetically, a first one of the closing parts being fastened to one of the closing elements and a second one of the closing parts being fastened to the strap guide frame; and displacing the second one of the closing parts relative to the strap guide frame to cancel the closing force or generate an opening force directed counter to the closing force.

11. The method as claimed in claim 10, further comprising:

displacing the second one of the closing parts from a closing position close to the stationary first one of the closing parts into an opening position remote from the first one of the closing parts.

12. The method as claimed in claim 10, further comprising:

an actuating drive generating an opening force with which the second one of the closing parts is displaced into the opening position and the closing parts interact with one another to generate a closing force with which the second one of the closing parts is displaced into the closing position.

13. The method as claimed in claim 11, wherein the magnetic closure device has an opening part which, in the opening position, lies close to a particular one of the closing parts, and wherein the particular one of closing part and the opening part are permanent-magnetic and identical poles of the particular one of the closing parts and the opening part face one another.

14. A method for strapping items with a strapping machine comprising:

providing the strapping machine including a strap guide frame having a strap guide channel and a plurality of closing elements fastened to the strap guide frame, wherein the closing elements are arranged in a distributed manner over the length of the channel and are moveable from a position closing the channel into a position opening the channel counter to a restoring force, wherein the closing elements are fixable in the position closing the channel via a closing force which is generated by a magnetic closure device; and altering the magnetic closure device to cancel the closing force or generate an opening force directed counter to the closing force, wherein the magnetic closure device has two closing parts which interact with one another, a first one of the closing parts being fastened to a closing element and a second one of the closing parts being fastened to the strap guide frame and of which one of the closing parts is permanent-magnetic and an other of the closing parts is either permanent-magnetic or ferromagnetic and wherein the magnetic closure device has an opening part which, in the opening position, lies close to a particular one of the closing parts, and wherein the particular one of the closing parts and the opening part are permanent-magnetic and identical poles of the particular one of the closing parts and the opening part face one another;

displacing the second one of the closing parts from a closing position close to the first one of the closing parts into an opening position remote from the first one of the closing parts; and displacing the opening part in the opening position close to the first one of the closing parts.

* * * * *